US005204723A

United States Patent [19]

Hanada et al.

[11] Patent Number: 5,204,723

[45] Date of Patent: Apr. 20, 1993

[54] HEATING APPARATUS HAVING HEATER WITH BRANCH

[75] Inventors: Shinji Hanada; Hisaaki Senba; Koji Masuda, all of Yokohama, Japan

[73] Assignee: Canon Kabushiki Kaisha, Tokyo, Japan

[21] Appl. No.: 786,556

[22] Filed: Nov. 1, 1991

[30] Foreign Application Priority Data

Nov. 2, 1990 [JP] Japan ..... 2-298419

[51] Int. Cl.[5] ..... G03G 15/20

[52] U.S. Cl. ..... 355/285; 219/216; 219/543; 219/549

[58] Field of Search ..... 355/282, 285; 219/216, 219/543, 549

[56] References Cited

U.S. PATENT DOCUMENTS

| | | | |
|---|---|---|---|
| 1,093,968 | 4/1914 | Bicknell | 219/543 X |
| 3,832,524 | 8/1974 | Takiguchi | 219/216 |
| 3,934,112 | 1/1976 | Lakhani | 219/216 |
| 4,075,455 | 2/1978 | Kitamura et al. | 219/216 |
| 4,628,183 | 12/1986 | Satomura | 219/216 |
| 4,801,968 | 1/1989 | Kogure et al. | 219/216 X |
| 4,883,941 | 11/1989 | Martin et al. | 219/216 |
| 5,045,891 | 9/1991 | Senba et al. | 355/289 |
| 5,051,784 | 9/1991 | Yamamoto et al. | 355/285 |
| 5,162,635 | 11/1992 | Sato et al. | 219/216 |

FOREIGN PATENT DOCUMENTS

| | | |
|---|---|---|
| 60-104348 | 6/1985 | Japan . |
| 61-84260 | 4/1986 | Japan . |
| 61-137759 | 6/1986 | Japan . |
| 3-114756 | 5/1991 | Japan . |
| 3-144477 | 6/1991 | Japan . |
| 3-194879 | 8/1991 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A heating apparatus includes a heater, the heater including a main resistance layer and a subordinate resistance layer branched from said main resistance layer, which extend in a direction crossing with a movement direction of a recording material and which are supplied with electric power; a selector for selecting a resistance layer for supplying electric power; and a controller for controlling an effective voltage applied to said heater in accordance with selected resistance layer.

21 Claims, 5 Drawing Sheets

HEATING APPARATUS HAVING HEATER WITH BRANCH

FIELD OF THE INVENTION AND RELATED ART

The present invention relates to a heating apparatus for heating an image on a recording material for improving its surface property or for fixing it.

U.S. Ser. No. 206,767 which has been assigned to the assignee of this application has proposed as a heating apparatus for heating an image on a recording material an image fixing apparatus using a quick response thermal heater and a thin film. The thermal heater comprises a heat generating resistance layer in the form of a line on a substrate. The heat generating resistance layer is required to have a length corresponding to a maximum width of recording materials usable with the apparatus. During the heat fixing operation, the longitudinal opposite ends of the heat generating resistor layer are connected to electric power source so that the entirety of the heat generating resistance layer generates heat. If the smaller size recording material is used with this structure, there exists sheet absent area outside the lateral ends of the sheet. The heat generating resistance layer produces the same quantity of heat in the sheet absent area and the sheet present area. In the sheet present area, the thermal energy produced by the heat generating layer is consumed for the image fixing operation. However, the thermal energy produced by the heat generating layer in the sheet absent area is not consumed for the image fixing, and therefore, thermal energy is accumulated. If, therefore, the heat fixing operation is continued, the temperature of the sheet absent portion or portions is excessively increased, with the possible result of a decrease of service life due to the thermal deterioration of the heater or the heat generating layer. In addition, there is a decrease of durability of the fixing film and pressing member or the like and/or an increase in instability of the movement of the fixing film (lateral shifting of the film, or production of crease of the film).

U.S. Ser. No. 603,223, now U.S. Pat. No. 5,171,969 proposes that the heat generating resistance layer has plural branches, and that the branches are selectively supplied with electric power, so that the quantity of heat generation in the sheet absent area is made smaller than the sheet present area, thus preventing temperature rise in the sheet absent area.

With this structure, if a constant voltage is applied irrespective of the selected branch even if the branches of the resistance layer are selectively energized, the following problems arise. The total resistance of the resistance layer is different if the selected branch is different, and therefore, the quantity of heat generated by unit length of the resistance layer in the sheet passing or present area. The temperature rising speed from the start of energization of the heater to the point where the temperature proper for the fixing operation is reached, and therefore, the initial image fixing power is not constant. In addition, a temperature ripple during a constant temperature control becomes different. If the ripple is too large, the uniformity of image fixing cannot be maintained. Furthermore, when a small size (width) recording material is heated for image fixing, the required energy is large.

SUMMARY OF THE INVENTION

Accordingly, it is a principal object of the present invention to provide a heating apparatus in which the temperature rising speed is stable from the start of the energization of the heater to the arrival at a target temperature.

It is another object of the present invention to provide a heating apparatus in which the variation in the temperature ripple in the constant temperature control is suppressed or removed.

It is a further object of the present invention to provide a heating apparatus in which the maximum power consumption is small.

It is a further object of the present invention to provide a heating apparatus comprising a heater with a main resistance layer and a subordinate resistance layer branched therefrom, selecting means for selecting a resistance layer to be supplied with electric energy and control means for controlling an effective voltage depending on selected resistance layer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 7:
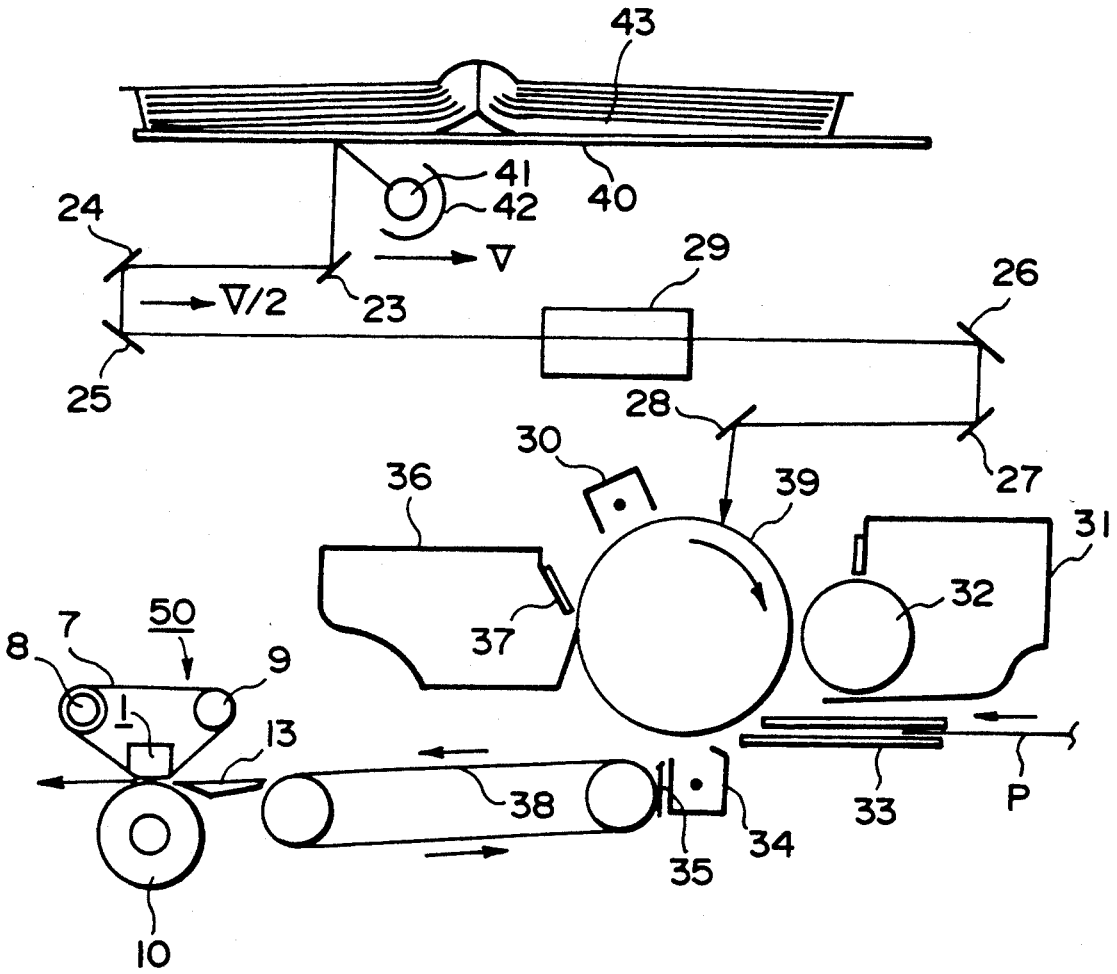
FIG. 7 is a sectional view of an image forming apparatus using the heating apparatus according to the embodiment of the present invention.

Referring first to FIG. 7, there is shown an image forming apparatus using a fixing apparatus 50 which is an exemplary heating apparatus according to an embodiment of the present invention. An original 43 is placed on a fixed original supporting platen glass 40. Then, the operator sets various copying conditions, and depresses a copy start key. Then, the photosensitive drum 39 is rotated at a predetermined peripheral speed in the clockwise direction (arrow).

A light source 41, a reflecting shade 42 and a first mirror move at a predetermined speed V from a home position at the left side of the glass platen to the right side of the glass along a bottom surface of the original supporting platen 40. Reference numeral 23 designates a first mirror. Second and third mirrors 24 and 25 move in the same direction at a speed V/2. By doing so, the bottom image surface of the original 43 on the original supporting platen glass 40 is illuminated and scanned from the left side to the right side, and the light reflected by the original is imaged through a slit on a rotating photosensitive drum 39 surface by way of an imaging lens and fixed fourth, fifth and sixth mirrors 26, 27 and 28.

Before the image exposure, the surface of the photosensitive drum 39 is uniformly charged to a predetermined positive or negative polarity by a primary charger 30. By the exposure of the charged surface, an electrostatic latent image is formed on the drum 39 surface. The thus formed electrostatic latent image on the photosensitive drum 39 surface is developed by a developing roller 32 of the developing apparatus 31 into a toner powder image.

By an unshown sheet feeding means, a transfer material sheet P (recording material) is supplied along a guide 33 to the image transfer station at a predetermined timing. At the image transfer station, a transfer charger 34 is faced to the drum 39. The sheet P is subjected to the transfer corona discharge, so that the toner image is transferred from the drum 39 to the sheet P.

The sheet P having passed through the image transfer station is sequentially separated from the drum 39 surface by an unshown separating means (a separating belt adjacent an end of the drum, for example). It is then subjected to electric discharging operation at its backside by discharging needles 35. It is introduced by the conveyer 38 along a guide 13 to an image fixing device 50 where the toner image is fixed. The sheet is finally discharged to the outside of the apparatus as a print or copy.

The drum 39 surface, after the image transfer operation, is cleaned by a cleaning blade 37 of a cleaning device 36 so that the residual toner or another contamination is removed from the drum, and the drum is prepared for the next image forming operation.

Figure 1:
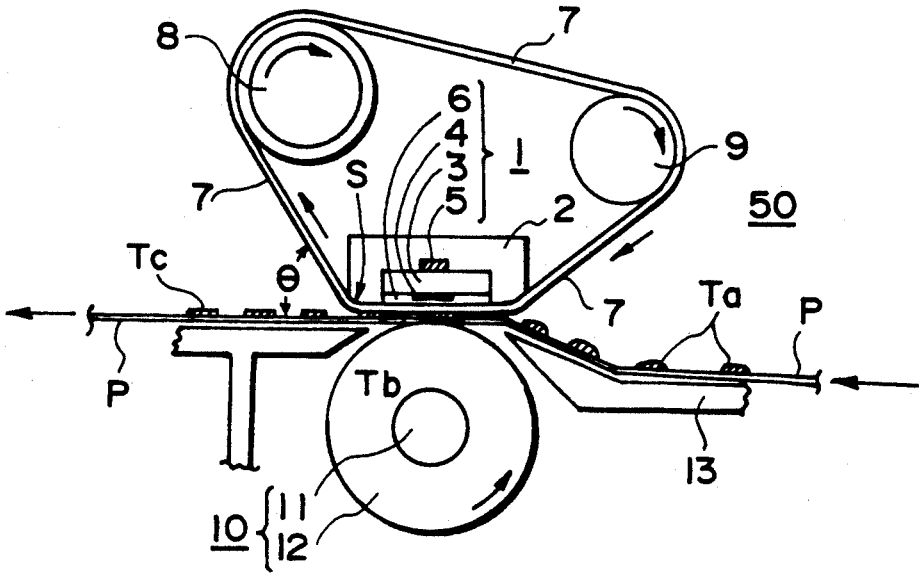
FIG. 1 is a sectional view of a heating apparatus according to an embodiment of the present invention.

Referring to FIG. 1, the description will be made as to a heating apparatus in the form of an image fixing apparatus. It comprises an image fixing film 7 in the form of an endless belt, a driving roller 8 (left side), a follower roller 9 (right side), a heater in the form of a low thermal capacity linear heater 1 disposed between and below the rollers 8 and 9. The belt 7 is trained around the members 8, 9 and 1.

The follower roller 9 functions as a tension roller for the fixing film 7. When the driving roller 8 rotates in the clockwise direction, the fixing film 7 also rotates in the clockwise direction without crease, snaking motion or delay, at a predetermined speed, that is, the speed at which the recording material carrying on its top surface an unfixed toner image Ta is fed from the image forming station.

The image fixing apparatus also comprises a back-up or pressing roller 10 functioning as a pressing member and comprising rubber elastic layer 12 made of material having good parting property such as silicone rubber. It is urged by an unshown urging means with a total pressure of 8–12 kg to a bottom surface of the heater 1 with a bottom travel portion of the film 7 therebetween. It rotates in the same peripheral direction as the recording material P about a shaft 11. More particularly, it rotates in the counterclockwise direction.

The heater 1 is in the form of a low thermal capacity linear heater extending in a direction perpendicular to the film 7 surface moving direction, particularly, in the direction perpendicular thereto (in the direction of the width of the film). The heater 1 comprises a heater base 3 having good electric insulation property and good thermal conductivity, a heat generating resistor 4 on the bottom surface of the base plate 3 and producing thermal energy upon electric power supply thereto, and a temperature detecting element 5. The heater is fixedly supported by a heater supporting member 2.

The heater supporting member 2 functions to supports the heater 1 on the fixing apparatus 50 and the image forming apparatus with heat insulation, and therefore, it has a heat insulating property, a high heat durability and high rigidity. It is made of PPS (polyphenylene sulfide), PAI (polyamide imide), PI (polyimide), PEEK (polyether ether ketone), liquid crystal polymer or another high heat durability resin, or a composite material of such a resin material and ceramic material, metal, glass or the like.

The heater base 3 is made of heat resistive, insulating, good thermal conductivity and low thermal capacity member. For example, it is in the form of an aluminum plate having a thickness of 1.0 mm, a width of 16 mm and a length of 340 mm.

The heat generating element 4 is provided on the bottom surface of the base 3 (opposite side from the film 7 contacting side) along the length thereof substantially at the center thereof. It is made of Ag/Pd (silver palladium), $Ta_2N$ or another electric resistance material in a thickness of approximately 10 microns and a width of 1–3 mm, and is painted by screen printing or the like. It is coated with a surface protection layer of heat-resistive glass having a thickness of approximately 10 microns.

A temperature detecting element 5, for example, is temperature detecting element having a low thermal capacity, such as Pt film or the like applied by screen printing or the like at substantially the center of the top surface of the base 3 (a side opposite from the heat generating member 4 provided side). Another example of the temperature detecting element is a low thermal capacity thermister contacted to the base plate 3.

The resistance layer thus formed is supplied selectively with high energy or low energy so that the temperature detected by the temperature detecting element 5 is substantially constant.

In the case of the heater 1 in this embodiment, the heat generating layer 4 has linear or stripe branches (FIG. 3), and the heat generating layer 4 is connected with the power source at the longitudinally opposite ends to generate heat over substantially the entire length thereof.

The fixing film 7 exhibits high thermal durability, good parting property, and high durability or the like. It is made of single or multiple layer films having a total thickness of not more than 100 microns, preferably not more than 40 microns.

Figure 2:
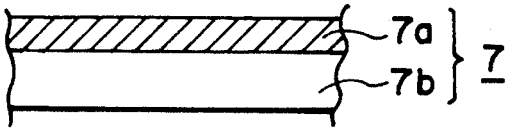
FIG. 2 is a sectional view of a film.

FIG. 2 shows an example of multi-layer structure, more particularly, a two layer structure. It comprises a base layer (base film) 7*b* which functions as a heat resistive layer and a parting layer 7*a* on the outer surface (toner image contactable side) of the heat resistive layer 7*b*.

Examples of the material of the heat resistive layer 7*b* includes polyimide, polyether ether ketone (PEEK), polyether sulfone (PES), polyether imide (PEI), polyparabanic acid (PPA) or other highly heat resistive resin material, or a metal such as Ni, SUS, Al or the like which are good in the strength and heat resistivity.

The parting layer 7*a* is preferably made of PTFE (polytetrafluoroethylene), PFA, FEP or another fluorine resin or silicone resin or the like (PTFE in this embodiment) If desired, carbon black, graphite, conductive whisker material or another conductive material may be added to the parting layer 7*a* to decrease the resistance of the surface of the fixing film 7. By doing so, the electric charging of the toner contacting surface of the fixing film 7 can be prevented. The parting layer 7*a* may be laminated on the heat resistive layer 7*b* by bonding laminating of the parting layer film, by electrostatic painting (coating) of the parting layer material, by evaporation, by CVD or by another film formation technique, or by co-extrusion of the heat resistive layer material and the parting layer material into a two-layer film.

In operation, the operator depresses a copy button, upon which image formation start signal is produced. Then, the image forming operation is carried out in the image forming apparatus (FIG. 7). Sooner or later, a recording sheet P carrying on its top surface an unfixed toner image Ta is introduced into the fixing apparatus 50. It is further introduced along a guide 13 into the fixing nip formed between the heater 1 and the pressing roller 10, more particularly into the nip between the fixing film 7 and the pressing roller 10. The recording sheet P is passed through the nip under the pressure by the heater 1 and the pressing roller 10, while the unfixed toner image carrying side of the sheet is overlaid on and close-contacted to the bottom surface of the fixing film in the same direction and at the same speed, without relative movement, crease or lateral shift. The heater 1 is actuated at predetermined timing from start of the image formation, and the temperature thereof reaches a predetermined level before the recording sheet P reaches the fixing nip.

The unfixed toner image Ta on the recording sheet P is heated and pressed by the nip and becomes a softened or fused image Tc.

The fixing film 7 is abruptly deflected (the angle is approximately 40 degrees) at a large curvature edge S (the radius of curvature is approximately 2 mm) of the heater support 2. Therefore, the sheet P passed through the nip with the fixing film 7 is separated from the fixing film 7 at the edge S (and is moved to the sheet discharge tray). Until the sheet is discharged, the toner is sufficiently cooled and solidified and is completely fixed on the sheet P into a toner image Tc.

In this embodiment, the heat generating element 4 and the base 3 of the heater 1 has a small thermal capacity, and they are thermally isolatedly supported by the supporting member 2, and therefore, the surface temperature of the heater 1 at the nip reaches a sufficiently high temperature in consideration of the toner fusing point or the fixable temperature to the sheet P, and therefore, it is not necessary to increase the temperature of the heater 1 beforehand (so-called stand-by temperature control). Therefore, the energy can be saved with the advantage of prevention of the inside temperature rise of the image forming apparatus.

Figure 3:
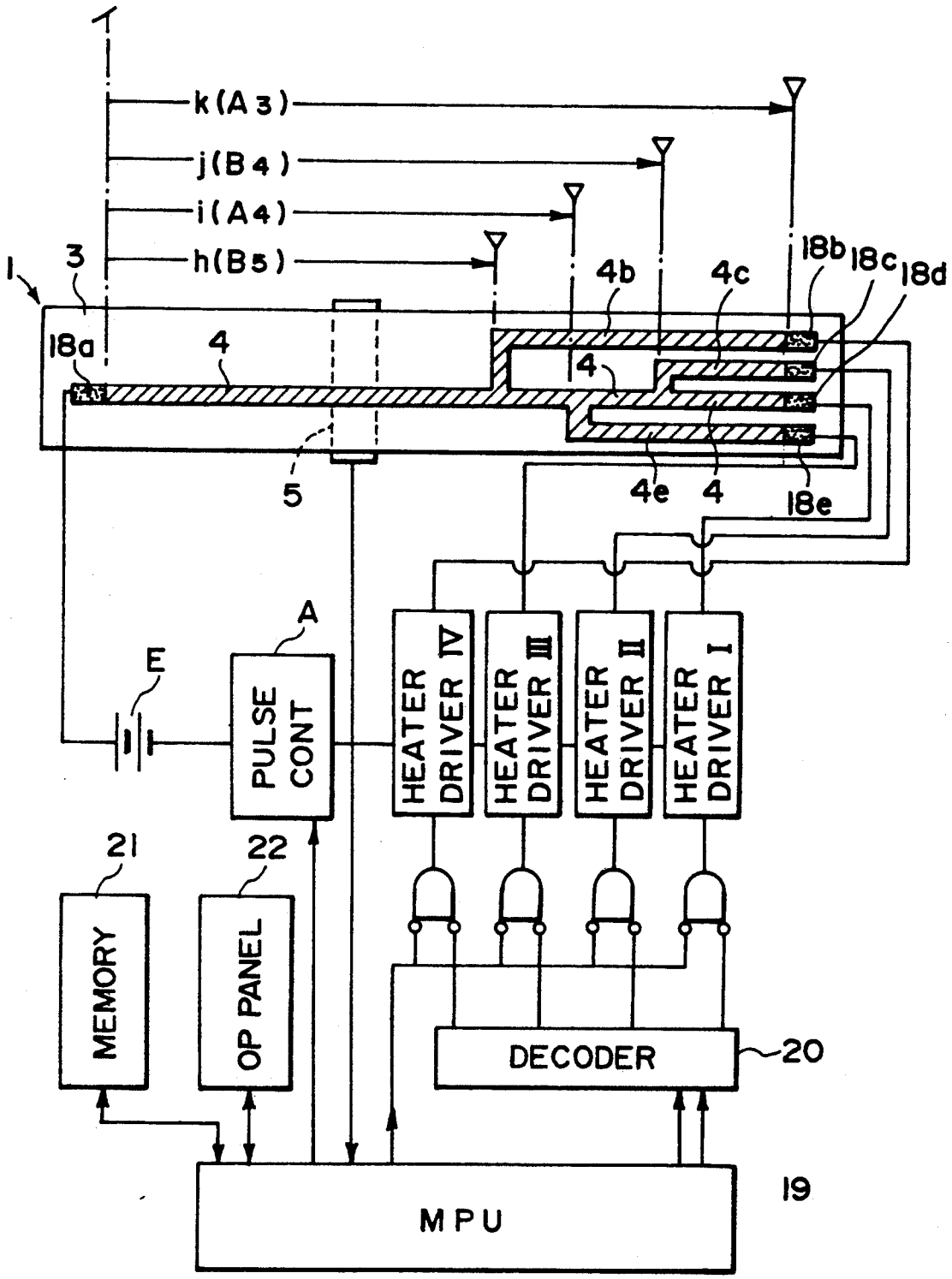
FIG. 3 is a block diagram of a control system for controlling power supply to a heater.

The description will be made as to the heater 1 and the power supply control in accordance with the size of the recording material in this embodiment FIG. 3 shows a block diagram for the power supply control for the heater, wherein references 4, **4*b*, 4*e* and 4*c* designate heat generating resistance layers formed on the bottom surface for sliding contact with the film, of the base 3 of the heater 1. The main heat generating resistance layer 4 corresponds to the maximum size of the recording material (A3). The subordinate heat generating resistance layers 4*b*, 4*e* and 4*c* are branched from respective positions corresponding to the recording material sizes of the main heat generating resistance layer 4 toward the non-sheet-passage portion. In this embodiment, the subordinate resistance layers 4*b*, 4*e* and 4*c* are of the same material as, have the same width and thickness as the main heat generating resistance layer 4**.

The main resistance layer 4 extends straight along the length of the base plate adjacent the center of the bottom surface of the base 3. Designated by reference numerals **18*a* and 18*d* are power supply electrodes (input contacts), made of good conductive material such as silver or the like, and provided at the left and right ends of the heat generating layer 4, respectively. The effective entire length of the heat generating layer between the electrodes 18*a* and 18*d*** is designated by k, which corresponds to a maximum width of usable sheets (A3).

In this embodiment, a reference line is indicated as a chain line at the upper right part of FIG. 3 as a left end of the main resistance layer 4. Various sheets of different sizes are supplied along the reference line (lateral reference type). The first subordinate resistance layer **4*b*, the second subordinate resistance layer 4*e* and the third subordinate resistance layer 4*c* are branched from the main resistance layer 4 at positions h, i and j away from the reference line. The ends of the branches are extended to the right end of the main resistance layer 4** or to the outside thereof.

Here, the distances h, i and j correspond to the widths of B5, A4 and B4 sheets.

Power supply electrodes **18*b* (input contacts) 18*b*, 18*e* and 18*c* are made of good electric conductivity material such as silver contacted to the free ends of the respective subordinate resistance layers 4*b*, 4*e* and 4*c***.

The bottom surface of the heater is in sliding contact with the film 7 and is provided with the main heat generating resistor layer 4, the subordinate heat resistance layers **4*b*, 4*e*, 4*c* and power supply electrode 18*a*, 18*d*, 18*b*, 18*e* and 18*c***. Therefore, it is preferable that the surface is protected by a protection layer against the sliding. Examples of the material of the protection layer include $Ta_2O_5$.

The temperature sensor 5 is disposed at a side opposite from the heat generating layer 4 provided side, that is, the top side of the base 3, and is disposed in the region h which is the minimum sheet-passing area.

Figure 4:
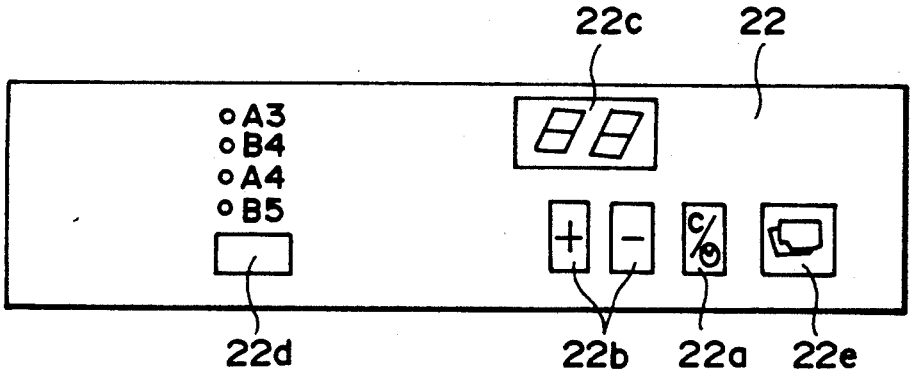
FIG. 4 is a top plan view of an operating panel.

FIG. 4 shows an operation panel 22 of the image forming apparatus shown in FIG. 7. The operation panel 22 is provided with a main switch **22*a*, a copy number setting key 22*b*, number display 22*c*, transfer material size selector key 22*d*, a copy start button 22*e* or the like. The size information is provided by size (width) detecting means which is the size selector key 22*d* in this embodiment. The size information is supplied to a microcomputer MPU 19 (FIG. 3). The size detecting means may be a means for detecting a size of the cassette. The MPU 19 supplies a decode signal corresponding to the size to a decoder 20**. The decoded signal selectively drives heater driving circuits I, II, III and IV which are selecting means for selectively supplying electric power to the heat generating resistance layers.

The microcomputer MPU 19 controls a pulse width control circuit A (voltage control means) so as to supply to the heater the effective voltage (pulse width in this embodiment) in accordance with the selected size. One side ends of the heater driver circuit I–IV are connected to the electrodes **18*d*, 18*c*, 18*e* and 18*b*, respectively. The other side ends of the circuits I–IV are made common and is connected to the electrode 18*a* (common electrode) at the left of the heat generating layer 4** through a power source E and a pulse width control circuit A.

The control system comprises a memory 21 for storing the control program for executing the operation.

Figure 5:
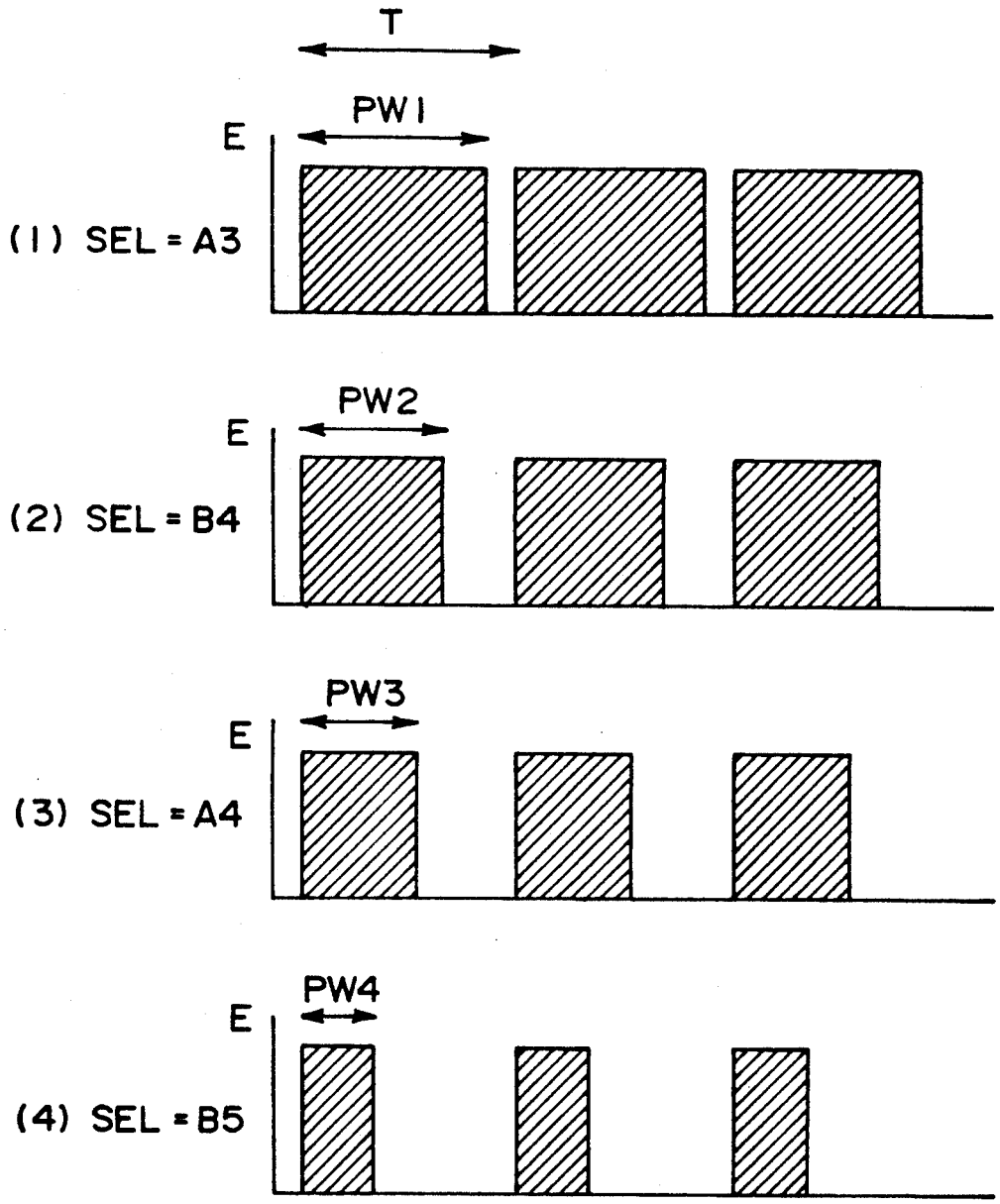
FIGS. 5 and 6 show the voltage supplied to the heater in accordance with the size of the recording material.

The description will be made as to the selection and power supply of the heat generating resistance layers in accordance with the size of the recording material. When an A3 sheet which is the maximum usable size (width) of the transfer material sheet is selected or designated, only the driver circuit I is driven, so that the first, second and third subordinate resistance layers 4b, 4e and 4c are in an open circuit, and therefore, only the heat generating layer 4 is supplied with electric power. At predetermined timing, a pulse voltage is applied between the electrodes 18a and 18d of the heat generating layer 4. The voltage has a duty pw1/T (86%) controlled by a known PWM (pulse width modulation control as shown in FIG. 5 (1). The entire effective length K of the heat generating layer 4 generates heat at a heat generating rate W per unit length. When the detected temperature of the temperature sensor 5 reaches a predetermined fixing temperature, the constant temperature control is started. When the temperature detected by the temperature sensor 5 becomes lower than the predetermined fixing temperature during the constant temperature operation, the power supply shown in FIG. 5 (1) is started. On the contrary, if it becomes higher than the fixing temperature, the pulse voltage supply is effected with the lower effective value than that shown in FIG. 5 (1). By doing so, the fixing temperature is maintained with a small ripple.

After the temperature of the base plate 3 reaches the fixing temperature, the recording sheet of A3 size is introduced into the fixing nip, and the toner image is fixed. In FIG. 5 PW1 designates a width of the pulse, and T designates a period.

When B4 size sheet is selected, both of the heater driver circuit I and II are driven, by which the power supply circuits including the main heat generating resistance layer 4 and the third subordinate heat generating resistor layer 4c are closed. Since the power supply circuit for the third subordinate resistance layer 4c as well as the power supply circuit for the main resistance layer 4, is closed, the resistance between the electrode 18a and the electrodes 18c and 18d is smaller than in the case of A3 sheet selected. Therefore, if the pulse voltage having the same effective level as in the A3 size sheet fixing, the amount of heat generated per unit length in the sheet-passage region increases. In consideration of this, the pulse voltage supplied between the electrode 18a and the electrodes 18c and 18d has a duty pw2/T (82%), where the pulse width PW1>will the pulse width PW2 (FIG. 5 (2)). By doing so, the amount of heat generated per unit length of the heat generating resistance layer in the sheet-passing area is substantially equal to the case of A3 size.

For this reason, the temperature rising speed from the start of the electric power supply to the arrival at the fixing temperature and the ripple during the constant temperature control, are substantially the same as in the case of A3 size sheet.

In this embodiment, the power supply continues even if the temperature sensor 5 detects a temperature higher than the target temperature during the constant temperature control, and therefore, the temperature is required to be lowered. In this case, it is preferable that the effective level of the voltage applied when the temperature is to be lowered is smaller than that in the case of A3 size.

In the heat generating layer portion corresponding to the sheet absent area (k - j), that is, in the portion between the branching portion of the third subordinate resistance layer 4c to the electrode 18d, a parallel electric circuit with the third resistance layer 4c is constituted, and the current flows both. Since the amount of heat generation is proportional to the current square, and therefore, the total amount of heat generation per unit length of the sheet absent area is approximately one half the sheet present area, and therefore, the temperature rise in the sheet absent area is prevented.

When A4 sheet is selected, both of the heater driver circuits I and III are driven, so that the electric power supply circuits for the heat generating resistor layer 4 and the second heat generating resistor 4e are closed.

The PWM control is effected to supply the pulse voltage having a duty of PW3/T (75%) (PW2>PW3) so as to provide a proper amount of heat generation W per unit length of the sheet passing or present area i, between the electrode 18a and the electrodes 18d and 18e (FIG. 5 (3)).

Therefore, the image fixing operation for the A4 sheet is carried out similarly to the cases of A3 and B4 sheets.

The sheet absent area (k-i), the amount of heat generation by the heat generating layer 4 and the branch 4e is smaller for the same reason as stated with the case of (2), so that the excessive temperature rise in the sheet absent area (k-i) can be prevented.

When a B5 size sheet is selected, both of the heater driver circuits I and IV are driven, so that the power supply circuits for the main resistance layer 4 and the first subordinate resistance layer 4b are closed.

Between the electrode 18a and the electrodes 18d and 18b, a pulse voltage having a duty PW4/T (70%) is applied (p3>pw4) (FIG. 5 (4)).

Thus, similarly to the case of A3, B4 and A4 sheets, the amount of heat generation per unit length of the sheet present area h is properly controlled. For the same reason, the excessive temperature rise does not occur in the sheet absent area (k-h).

In FIG. 5, for the purpose of easier understanding, the difference in the effective voltages are exaggerated.

Thus, the electric power supply is changed by changing the effective voltage in accordance with the selection of the heat generating resistance layer to be used. Particularly, the power supply is decreased with the decrease of the resistance, the heat generating amount per unit length in the sheet passage area made constant irrespective of the size of the recording material.

In the foregoing embodiments, a DC source is used and the DC voltage was applied.

Figure 6:
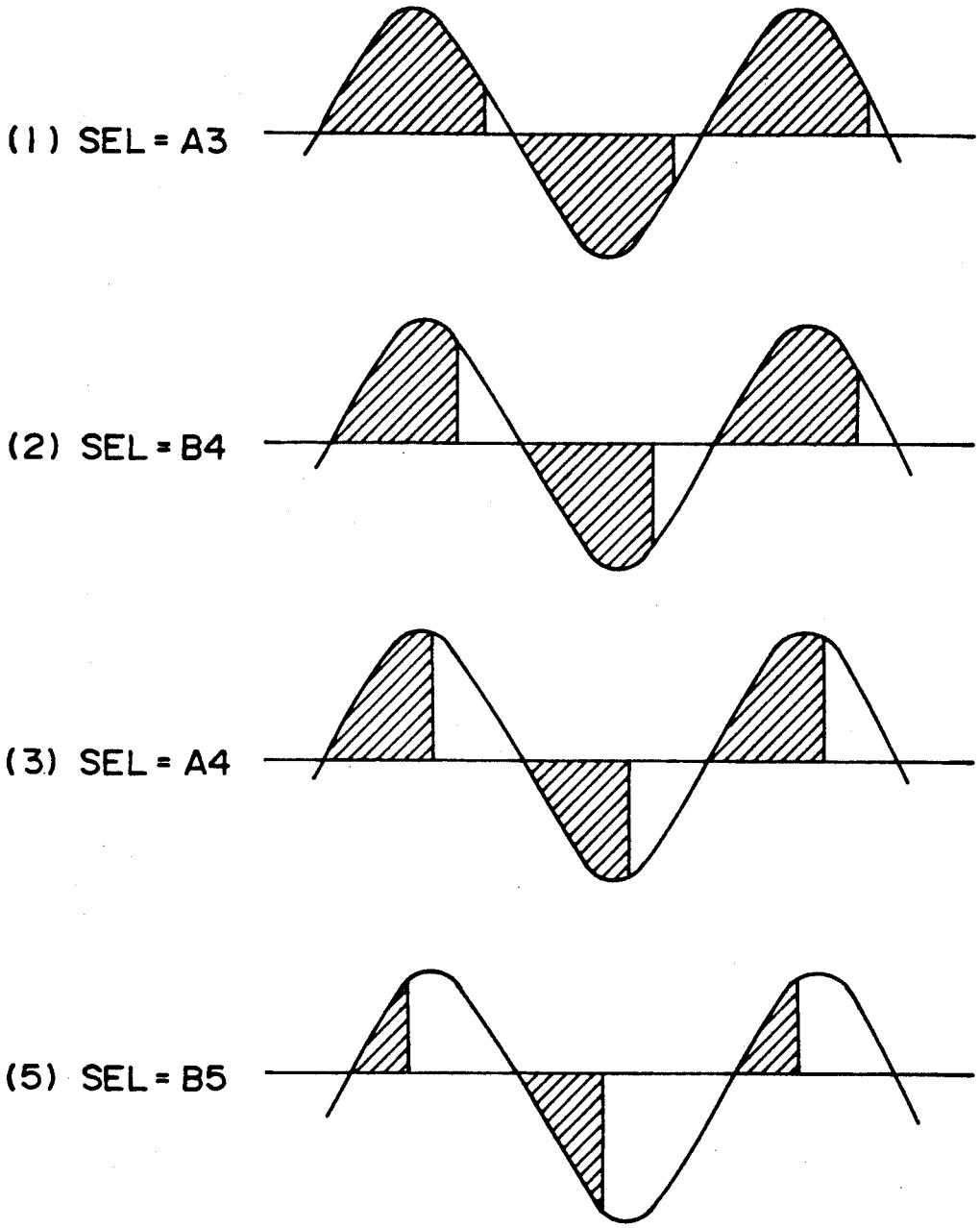

Referring to FIG. 6, the description will be made as to the embodiment in which a AC voltage is applied. FIG. 6 shows a waveform of a voltage having a controlled phase. (1), (2), (3) and (4) are for A3 sheets, A4 sheets and B5 sheets. The voltages are applied between the longitudinal ends of the heat generating layer. The phase angle is reduced with decrease of the width of the recording sheet, so that the effective voltage is decreased.

When a AC voltage is used, the number of waves rather than the phase angle can be controlled so that the power supply period per unit time is changed, by which the effective voltage is changed.

While the invention has been described with reference to the structures disclosed herein, it is not confined to the details set forth and this application is intended to cover such modifications or changes as may come within the purposes of the improvements or the scope of the following claims.

What is claimed is:

1. A heating apparatus, comprising:

a heater, said heater including a main resistance layer and a subordinate resistance layer branched from said main resistance layer which extend in a direction crossing with a movement direction of a recording material and which are supplied with electric power;

selecting means for selecting a resistance layer to be supplied with electric power in accordance with a size of the recording material, said selecting means selecting the resistance layers so that a number of resistance layers selected is larger in an area where the recording material does not pass than in an area where the recording material passes; and control means for controlling an effective voltage applied to said heater in accordance with selected resistance layer.

2. An apparatus according to claim 1, further comprising a film movable together with a recording material having an image, wherein the image is heated by heat from said heat resistance layer.

3. An apparatus according to claim 2, further comprising a pressing member for pressing said film and the recording material with said heater.

4. An apparatus according to claim 1, wherein the number in the recording material passing area is one, and the number in the non-passage area is two.

5. An apparatus according to claim 1, wherein said control means controls a pulse width of the applied voltage to control the effective voltage.

6. An apparatus according to claim 1, wherein said control means controls a phase of the voltage to control the effective voltage.

7. An apparatus according to claim 1, wherein said control means effects its control operation so as to provide a constant amount of heat generation by said heater per unit length thereof in the recording material passage region, irrespective of the size of the recording material.

8. An apparatus according to claim 1, wherein said control means increases the effective voltage with increase of a size of the recording material.

9. A heating apparatus, comprising:

a heater including a main resistance layer and a subordinate resistance layer branched therefrom which extend in a direction perpendicular to a movement direction of a recording material and which are supplied with electric power;

selecting means for selecting a resistance layer to be supplied with electric power in accordance with a width of the recording material, said selecting means selecting the resistance layers so that a number of resistance layers selected is larger in an area where the recording material does not pass than in an area where the recording material passes; and control means for controlling the power supply in accordance with selection by said selecting means, wherein said control means decreases the power with decrease of the width of the recording material.

10. An apparatus according to claim 9, further comprising a film movable together with a recording material having an image, wherein the image is heated by heat from said heat resistance layer.

11. An apparatus according to claim 9, further comprising a pressing member for pressing said film and the recording material with said heater.

12. An apparatus according to claim 9, wherein said control means effects its control operation by changing a pulse width of the power supply.

13. An apparatus according to claim 9, wherein said control means effects its control operation by controlling a phase of the power supply.

14. An apparatus according to claim 9, wherein said control means effects its control operation so that an amount of heat generation per unit length of said heater in the recording material passage area is constant irrespective of the size of the recording material.

15. A heating apparatus, comprising:

a heater including a main resistance layer and a subordinate resistance layer branched from said main resistance layer which extend in a direction perpendicular to a movement direction of a recording material and which are supplied with electric power;

selecting means for selecting a resistance layer to be supplied with the electric power in accordance with a size of the recording material, said selecting means selecting the resistance layers so that a number of resistance layers selected is larger in an area where the recording material does not pass than in an area where the recording material passes; and control means for controlling power supply period per unit time in accordance with the resistance layer selected.

16. An apparatus according to claim 15, further comprising a film movable together with a recording material having an image, and the image is heated by heat from said heat resistance layer.

17. An apparatus according to claim 16, further comprising a pressing member for pressing said film and the recording material with said heater.

18. An apparatus according to claim 15, wherein said control means effects is control operation by controlling a pulse width of the power supply.

19. An apparatus according to claim 15, wherein said control means effects its control operation by changing a phase of the electric power supply.

20. An apparatus according to claim 19, wherein said control means effects its control operation so that an amount of heat generation per unit length of said heater in the recording material passage area is constant irrespective of the size of the recording material.

21. An apparatus according to claim 19, wherein said control means increases the power supply period with increase of the recording material passage area.

* * * * *

UNITED STATES PATENT AND TRADEMARK OFFICE

CERTIFICATE OF CORRECTION

PATENT NO. : 5,204,723
DATED : April 20, 1993
INVENTOR(S) : SHINJI HANADA, ET AL.

It is certified that error appears in the above-indentified patent and that said Letters Patent is hereby corrected as shown below:

Column 3
Line 67, "ports" should read --port --.

Column 7
Line 34, "circuit" should read --circuits--;
Line 40, "is" should read --are--.

Column 8
Line 58, "a" should read --an--.

Column 9
Line 16, "selected" should read --the selected--.

Column 10
Line 50, "Claim 19," should read --Claim 15,--;
Line 55, "Claim 19," should read --Claim 15,--.

Signed and Sealed this
Fifth Day of July, 1994

*Attest:*

*Attesting Officer*

BRUCE LEHMAN

*Commissioner of Patents and Trademarks*